US006010991A

United States Patent [19]

Dabestani

[11] Patent Number: 6,010,991

[45] Date of Patent: Jan. 4, 2000

[54] INDUSTRIAL ANTI-MICROBIAL HAND SOAP

[75] Inventor: Al Dabestani, Dublin, Ohio

[73] Assignee: State Industrial Products, Cleveland, Ohio

[21] Appl. No.: 09/301,797

[22] Filed: Apr. 29, 1999

[51] Int. Cl.[7] ..... C11D 1/62; C11D 3/14; C11D 3/382

[52] U.S. Cl. ..... 510/139; 510/130; 510/131; 510/137; 510/138; 510/235; 510/236; 510/319; 510/368; 510/384; 510/391; 510/395; 510/463

[58] Field of Search ..... 510/130, 131, 510/137, 138, 139, 235, 236, 368, 384, 391, 395, 463, 319

[56] References Cited

U.S. PATENT DOCUMENTS

| | | | |
|---|---|---|---|
| 3,899,437 | 8/1975 | Regan et al. | 252/106 |
| 3,997,460 | 12/1976 | Sirine et al. | 252/106 |
| 4,336,151 | 6/1982 | Like et al. | 252/106 |
| 4,420,484 | 12/1983 | Gorman et al. | 424/326 |
| 4,455,250 | 6/1984 | Frazier | 252/106 |
| 4,540,505 | 9/1985 | Frazier | 252/106 |
| 4,561,993 | 12/1985 | Choy et al. | 252/174.25 |
| 5,063,062 | 11/1991 | Greenspan et al. | 424/443 |
| 5,188,822 | 2/1993 | Viccaro et al. | 424/52 |
| 5,441,666 | 8/1995 | Dotolo | 252/170 |
| 5,626,837 | 5/1997 | Shimada et al. | 424/49 |
| 5,661,119 | 8/1997 | Hersch et al. | 510/139 |
| 5,679,877 | 10/1997 | Erilli et al. | 510/218 |
| 5,728,672 | 3/1998 | Richter | 510/463 |

*Primary Examiner*—Yogendra Gupta
*Assistant Examiner*—Charles Boyer
*Attorney, Agent, or Firm*—Lightbody & Lucas

[57] ABSTRACT

Liquid industrial anti-microbial hand soaps are provided for removal of foreign matters from skin and imparting dermal conditioning and softness. When in the form of stable homogeneous liquid, the composition may contain: a) surfactant or surfactants with hydrotropic properties as solubilizer and wetting agent; b) fatty amphoteric compounds as primary and secondary surfactant, antistatic agents; c) fatty amine oxides or amides as conditioning agents; d) distearate as thickening agent; e) essential oil; f) abrasive; and/or, g) water. The soaps preferably include in homogenous solution 1–2% of a quaterized anti-microbial, 10–30% surfactants and emulsifiers, 2–3% essential orange oil, 2–4% of a hydropolymer abrasive and the rest deionized water—all percentages by weight.

14 Claims, No Drawings

INDUSTRIAL ANTI-MICROBIAL HAND SOAP

FIELD TO WHICH THE INVENTION RELATES

The present invention relates to a hand soap which is utilized in industrial, commercial, agricultural, and other applications wherein it is necessary to remove dirt, lubricants, and other materials off of the human body, most particularly the hands.

BACKGROUND OF THE INVENTION

Soaps are utilized in many differing industries, primarily to remove the dirt and other debris from a person's skin. These soaps are typically substances which can be used with water to produce suds for washing or cleaning, usually a sodium or potassium salt of a fatty acid produced by the action of an alkali such as caustic soda or potash on fats or oils. These hand soaps are serviceable.

With the increasing ability of manufacturers to understand the nature of this cleansing process, the chemical compositions for these cleaning agents include specific types of surfactants and conditioning agents and other molecule based and defined components.

The present invention broadly relates to a cleaning composition and, in particular, to an anti-microbial hand soap with industrial strength for dermal cleansing while also imparting conditioning properties. In one of its more specific aspects, the invention is concerned with a relatively stable homogeneous liquid solution for use in industrial and commercial dermal cleansing and conditioning as well as a specific novel product that simultaneously achieves soil removal and an appreciable softness to one's skin, therefore preventing skin dryness, irritation and skin flaking.

The preferred homogeneous composition combines quaterized fatty amines together with a proportion of surfactants and conditioning surface active agents. The soap possesses a number of advantages which are attractive from the standpoints of efficacy and sales appeal. Further, the combination provides excellent conditioning, anti-microbial and, in most cases, antibacterial properties.

In this invention the preferred synergistic combination of quaterized amines, essential oil and hydropolymer abrasives make the product more effective not only in removing particulate and oily soils form skin but also in enhancing the anti-microbial efficacy of the finished product. In the form of stable homogeneous liquid, the composition may also contain: a) surfactants with hydrotropic properties as a solubilizer and wetting agent; b) fatty amphoteric compounds as primary and secondary surfactants and antistatic agents; c) fatty amine oxides or amides and conditioning agents; d) a distearate as a thickening agent; and, e) water.

DETAILED DESCRIPTION OF THE INVENTION

In accordance with one presently preferred variant of the invention, a relatively stable homogeneous liquid composition for industrial anti-microbial hand soap imparting dermal conditioning thereto is provided. The liquid composition contains about 1–5% and preferably 1–2% of an anti-microbial agent, about 10–45% and preferably 10–30% of surfactants and emulsifiers, about 1–5% and preferably 1–2% of hydrotrope, about 1–7% and preferably 1–3% of thickening agents, about 1–5% and preferably 2–3% of a conditioning agent, about 3–10% and preferably 3–5% of essential oil, about 0.2–1.0% and preferably 0.2–0.5% of preservative, about 5–15% and preferably 7–10% of anti-irritant and conditioner, about 2–6% and preferably 3–4% of anti-static agents, about 0.1–0.5% and preferably 0.1–0.2% of inorganic chealating agent, about 1–6% and preferably 2–4% of an abrasive, and about 50–80% and preferably 60–70% of water. All quantities and percentages mentioned herein including the claims are calculated on weight basis unless specifically indicated to the contrary.

The compositions are for a novel product that simultaneously achieves soil removal and an appreciable softness on the skin, therefore preventing skin dryness, irritation, and skin flaking without the use of conventional solvents such as hydrocarbon solvents, kerosene, mineral spirit, and parafinic solvents. These products, as effective as they are in removing oily soil from skin, possess unpleasant odor and contribute to skin dryness.

The three agents that add most to the preferred embodiment of the invention are the quaterized anti-microbial, the essential oil, and the abrasive.

Quaternary fatty amines are excellent conditioning and anti-microbial agents and in most cases antibacterial agents are widely used for this purpose. The synergistic effect of orange oil as solvent, anti-microbial and cleansing constituent and quaternary differentiate this product from other in the market. A suitable homogeneous composition combining the proper proportion of appropriate surfactants and concentration of conditioning agents and surface active agents would posses a number of advantages which are attractive from the standpoints of efficacy and sales appeal. In this invention the synergistic combination of quaternary and essential oil made the product more effective not only in removing particulate and oily soils from skin it also enhances the anti-microbial efficacy of the finished product.

The quaterized anti-microbial (QUAT), a fatty amine disclosed, controls the current as well as inhibits the development of future microbes. In addition, the QUAT acts as a skin conditioner, aiding in the treatment and prevention of drying and flaking skin. The QUAT has the chemical formula of a Quaterized fatty amine corresponding to the following structural formula:

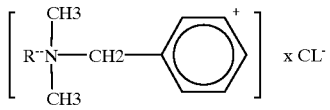

Where R is selected from a group consisting of 10–16 carbon atoms. Example QUATs utilized as an anti-microbial agent (1–5% with 1–2% preferred) are:

| Chemical Description | Trade Name | Manufacturer |
|---|---|---|
| Alkyl Benzyl alkanolammonium chloride | BTC 65 NF | Stepan |
| Alkyl Benzyl alkanolammonium chloride | BTC 50 NF | Stepan |

The essential oil (OIL), orange oil disclosed, enhances the cleansing properties of the soap itself and in synergistic cooperation with the other components therein. The Terpene base essential oil is also incorporated in the composition to enhance the cleansing and anti-microbial efficacy of the final product. Orange oil is preferred for being a biodegradable, non-toxic, non-hardous, with anti-microbial and cleansing properties. The orange oil and QUAT synergism makes a potent anti-microbial product.

Example OILs utilized include Terpene, (3–10% with 3–5% preferred) are:

| Chemical Description | Trade Name | Manufacturer |
|---|---|---|
| Orange Terpene | Orange Oil | Givaudan Roure |
| Orange Terpene | Orange Oil | Firmenich |

To further enhance the cleaning efficacy of the product, an abrasive oxidized polyethylene homopolymer compound was added to remove embedded soil from skin by physical action. The abrasive, a homopolymer disclosed, mechanically removes dirt and other hand debris. To further enhance the cleaning efficiency of the product, the oxidized polyethylene homopolymer compound is added to remove soil from skin by mechanical action without the harshness of pumice like abrasives. Due to inert nature of polyethylene homopolymers, these products do not interfere with QUATS. They are not as harsh on skin as pumice. They are less likely to clog the drain pipes and can be flushed away easily.

Examples of substants utilized as an abrasive (1–6% with 2–3% preferred) include:

| Chemical Description | Trade Name | Manufacturer |
|---|---|---|
| Polyethylene Homopolymer | Microscrub | Micropowder |
| Polyethylene Homopolymer | ACmist | Allied Signal |

In addition to the above components, the hand soap includes other components including surfactants, emulsifiers, a thickening agent and water.

The surfactant, a fatty alcohol ethoxylate disclosed, adds a detergent property to the soap. This facilitates the removal of grease, oils, and other debris from the skin. In addition, the surfactant stabilizes the product while also adding some thickening thereto. The specific liquid composition also contains a nonionic surface-active agent which provides cleansing and foam boosting properties. This agent is in the form of a fatty alcohol ethoxylate with the following structure:

CH3(CH2)n—O—(CH2CH2O)xH

Where n is 5–9 and x of average 5–7. An example Surfactant (10–45% with 10–20% preferred) is:

| Chemical Description | Trade Name | Manufacturer |
|---|---|---|
| Fatty alcohol ethoxylate | DeThox DA-6 | DeForest |

In addition to this primary surfactant, the preferred embodiment also includes a secondary auxiliary surfactant. This substance, an esterified coco, adds additional softness and moisturizing properties to the compound in a PH neutral way. The particular auxiliary surfactant is fatty amphoteric compounds derived from esterified coco corresponding to the structural formula:

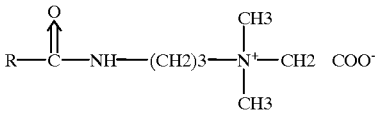

Where R is a coco with C8–C18 carbon atoms. An example Amine Oxide (9–15% with 11–13% preferred) is:

| Chemical Description | Trade Name | Manufacturer |
|---|---|---|
| Coco amido propyl dimethyl amine oxide | Amyx CDO | Boeheme Filatex |

The thickening agent, a glycol distearate disclosed, adds body and thickness to the soap. It acts as a viscosity, foam booster and stabilizer providing stability for the components in suspension in the solution of the soap. In the preferred soap, a polyethylene glycol distearate of average molecular weight of 7000–8000 is used as a thickener and auxiliary emulsifier. This distearate has the following molecular structure:

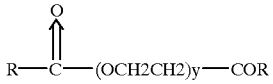

Where R+C14–C16, y=140–180 and COR represents the stearic radical. An example Thickener (1–7% with 1–3% preferred) is:

| Chemical Description | Trade Name | Manufacturer |
|---|---|---|
| PEG-150 Pentaerthrityl tetrasstearate | Crothix | Coroda |
| Polyadrylic acid polymer | Carbopol | BF Goodrich |

The water, deionized preferred, serves to maintain the other components in proximity in solution, thus providing for an efficient transfer of the components to the skin of the user. Water is included (50–80% with 60–70% preferred) of:

Deionized $H_2O$

In the preferred embodiment disclosed, the soap also includes additional organic compounds, amines and amides preferred, that are used to facilitate the removal of fats, oils, and grease as well as dirt and debris. The particular amine oxide and amides have the structure:

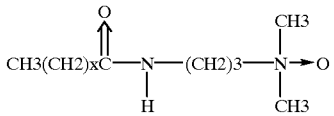

Where x is 6–18. And/or of structure of:

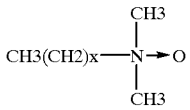

Where x is 10–18. The amine may be of the following structure:

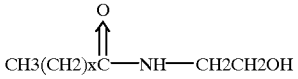

Where x is 10–15. Examples Amines and Amides include:

| Chemical Description | Trade Name | Manufacturer |
|---|---|---|
| (Amine Oxides) | | |
| Cooamidopropyl amine oxide | Foamox CDO | Alzo Inc. |
| Cooamidopropyl amine oxide | Chemoxide CAW | Chemron Corp. |
| Cooamidopropyl amine oxide | Varox 1770 | Witco |
| Cetyl dimethyl amine oxide | Aromox DM16 | Akzo |
| (Amides) | | |
| Lauramide MEA | Mackamide L | McIntyre Group |
| Lauramide MEA | Monamide 1159 | Mona Industries |
| Lauramide MEA | Monamide 1224 | Mona Industries |

The soap composition also includes amphoterics, an inorganic chealating agent, antistatic agents, hydrotrope agents, and preservatives.

The amphoterics have both basic and acid properties while being compatible with cationics, anionics and nonionics. They possess mildness, non-toxic and hard water tolerance properties. They tend to inactivate the stinging or damaging effects of irritant, some amphoterics and show antistatic properties. The amphoterics thus are able to aid in the removal of particulate agents (e.g., sand, dust) without altering the basic cleansing action of the hand soap.

Example amphoterics (15–25% with 15–20% preferred) include:

| Chemical Description | Trade Name | Manufacturer |
|---|---|---|
| (Basic and Acid Properties) | | |
| Cocamidopropyl Betaine | Chembetaine CGF | Chemron Corp. |
| Cocamidopropyl Betaine | Detaine CAPB-35 | Deforest |
| Cocamidopropyl Betaine | Rewoteric | Witco |
| Cocamidopropyl Betaine | Monateric COAB | Mona |

The action of chealating agents is to lockup polyvalent ions, normally found in hard water, in their molecule and make the ions undetectable or inactive.

An example chealating agent (0.1%–0.5% with 0.1%–0.2% preferred) is:

| Chemical Description | Trade Name | Manufacturer |
|---|---|---|
| (Chealating Agent) | | |
| Nitrilotriacetic acid | NTA | |
| Hydroxyamino Carboxylic Acid | | |
| Amino Carboxylic Acid | | |

The antistatic agents reduce the static charge PH. Example antistatic agents (2–6% with 3–4% preferred) are:

Most cationics fall in this category.

The emulsifier adds to the stability of the soap in solution. An example emulsifier (1–5% with 1–2% preferred) are the same as the amine oxides.

The preservatives aid in maintaining the composition in the state as it was designed. It also reduces the chances of external harm to the solution. An example preservative (0.2–1% with 0.2–0.5% preferred) is:

| Chemical Description | Trade Name | Manufacturer |
|---|---|---|
| DMDM Hydantoin | Glydant | Lonza |
| DMDM Hydantoin | Custom DMDM | Custom Ingredients, Inc. |

Although the invention has been described in its preferred form with a certain degree of particularity, it is to be understood that numerous changes may be made without deviating from the invention as hereinafter claimed.

I claim:

1. A skin cleaner comprising from 1–5% of a quaterized anti-microbial of a fatty amine corresponding to the following structural formula:

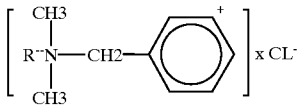

wherein R is an alkyl group of between 10–16 carbon atoms from 1–6% of an abrasive, from 3–5% of an essential oil, and the remainder water.

2. The skin cleaner of claim 1 characterized in that said abrasive is an oxidized polyethylene homopolymer compound.

3. The skin cleaner of claim 1 characterized in that said essential oil is orange oil.

4. The skin cleaner of claim 1 characterized by the addition of from 10–45% of a surfactant and an emulsifier.

5. The skin cleaner of claim 4 characterized in that said surfactant includes at least a fatty alcohol ethoxylate.

6. The skin cleaner of claim 4 characterized in that said emulsifier includes at least a polyethylene glycol distearate.

7. The skin cleaner of claim 6 characterized in that said distearate corresponds to the following structural formula:

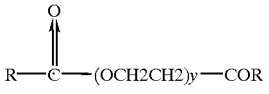

Where R=C14–C16, y=140–180 and COR represents the stearic radical.

8. The skin cleaner of claim 4 characterized by the addition of an auxiliary surfactant.

9. The skin cleaner of claim 1 characterized by the addition of 1–7% of a thickening agent.

10. The skin cleaner of claim 9 characterized in that said thickening agent includes at least a pentaerthrityl tetrastearate.

11. The skin cleaner of claim 9 characterized in that said thickening agent includes at least a polyacrylic acid polymer.

12. The skin cleaner of claim 1 characterized by the addition of additional organic compounds.

13. The skin cleaner of claim 12 characterized in that said additional organic compounds include amines.

14. The skin cleaner of claim 12 characterized in that said additional organic compounds include amides.

* * * * *